US007637013B2

(12) United States Patent
Hayakawa

(10) Patent No.: US 7,637,013 B2
(45) Date of Patent: Dec. 29, 2009

(54) METHOD OF MANUFACTURING INK JET RECORDING HEAD

(75) Inventor: Kazuhiro Hayakawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 25 days.

(21) Appl. No.: 11/464,006

(22) Filed: Aug. 11, 2006

(65) Prior Publication Data

US 2007/0058001 A1 Mar. 15, 2007

(30) Foreign Application Priority Data

Aug. 23, 2005 (JP) ..... 2005-241049

(51) Int. Cl.
*B21D 53/76* (2006.01)

(52) U.S. Cl. ..... 29/890.1; 29/25.35; 29/611; 216/66; 216/94; 216/27; 347/44; 524/102

(58) Field of Classification Search ..... 29/890.1, 29/25.35, 611; 216/27, 41, 49, 67, 66, 94; 427/97, 255.6, 387; 438/65; 347/40, 44, 347/45, 47; 524/102
See application file for complete search history.

(56) References Cited

U.S. PATENT DOCUMENTS

| | | | | |
|---|---|---|---|---|
| 3,374,111 | A * | 3/1968 | Brennemann | 427/255.6 X |
| 3,600,216 | A * | 8/1971 | Stewart | 427/387 X |
| 4,923,915 | A * | 5/1990 | Urruti | 524/102 |
| 5,218,376 | A | 6/1993 | Asai | |
| 5,458,254 | A * | 10/1995 | Miyagawa et al. | 216/27 |
| 5,478,606 | A * | 12/1995 | Ohkuma et al. | 427/555 |
| 5,663,752 | A * | 9/1997 | Imamura et al. | 347/65 |
| 5,945,260 | A * | 8/1999 | Miyagawa et al. | 430/320 |
| 6,461,798 | B1 * | 10/2002 | Ohkuma et al. | 430/320 |
| 6,787,191 | B2 * | 9/2004 | Hanahata et al. | 427/387 |
| 7,055,938 | B1 * | 6/2006 | Ohkuma et al. | 347/65 |
| 7,063,799 | B2 | 6/2006 | Hayakawa et al. | |
| 2003/0082841 | A1 * | 5/2003 | Haluzak et al. | 438/21 |

(Continued)

FOREIGN PATENT DOCUMENTS

| | | | |
|---|---|---|---|
| EP | 609860 | A2 * | 8/1994 |
| EP | 665107 | A2 * | 8/1995 |
| JP | 05193144 | A * | 8/1993 |
| JP | 06011716 | A * | 1/1994 |
| JP | 07209864 | A * | 8/1995 |

(Continued)

OTHER PUBLICATIONS

Sato et al., "Photoresist Characteristics of Polyurea Films Prepared by Vapor Deposition Polymerization," Japanese Journal of Applied Physics, vol. 33, (Dec. 1994), pp. L1721-L1724.

*Primary Examiner*—A. Dexter Tugbang
(74) *Attorney, Agent, or Firm*—Fitzpatrick, Cella, Harper & Scinto

(57) ABSTRACT

A method, which is capable of manufacturing an ink jet recording head with a high degree of accuracy even though the density of an ink passage pattern is increased, includes the steps of forming an ink passage pattern on a substrate formed therein with an ink discharge pressure generating element from dissoluble resin; depositing an organic material on the substrate formed thereon with the ink passage pattern from the dissoluble resin by a vapor growth process at a temperature at which the dissolubility of the dissoluble resin is not lost, so as to form a coated resin layer; forming an ink discharge port in the coated resin layer in parts located above the ink discharge pressure generating element; and eluting the dissoluble resin.

3 Claims, 2 Drawing Sheets

U.S. PATENT DOCUMENTS

2004/0238485 A1 12/2004 Hayakawa et al.
2005/0140737 A1 6/2005 Ushijima et al.
2005/0248623 A1 11/2005 Komuro et al.
2006/0191862 A1 8/2006 Hayakawa et al.
2006/0214995 A1 9/2006 Hayakawa et al.
2006/0256162 A1 11/2006 Hayakawa
2007/0058001 A1* 3/2007 Hayakawa ..... 347/65

FOREIGN PATENT DOCUMENTS

JP 2001113712 A * 4/2001
JP 2004-074469 * 12/2002
JP 2004230627 A * 8/2004

* cited by examiner

METHOD OF MANUFACTURING INK JET RECORDING HEAD

This application claims the benefit of Japanese Patent Application No. 2005-241049, filed Aug. 23, 2005, which is hereby incorporated by reference herein in its entirety.

BACKGROUND OF THE INVENTION

1. Field of the Invention

The present invention relates to a method of manufacturing an ink jet recording head for discharging droplets.

2. Description of the Related Art

An ink jet recording head used in an ink jet recording system (liquid jetting recording system) incorporates several microscopic recording liquid discharge ports, liquid passages and liquid discharge pressure generating portions which are formed in a part of the liquid passages. Further, in order to obtain a high quality image by this ink jet recording head, droplets of recording liquid (ink) are always discharged from the respective discharge ports, desirably by one and the same volume at an equal discharge speed.

As a method which can satisfy the above-mentioned desire, the specification of U.S. Pat. No. 5,218,376 discloses a method in which air bubbles are formed in ink by generating thermal energy in ink discharge pressure generating elements (electrothermal transducer elements), and the thus formed air bubbles are communicated with the ambient air so as to discharge the ink droplets. In an ink jet recording head which can achieve the above-mentioned method, the shorter the distance (which will be hereinbelow referred to as "OH distance") between each of the electrothermal transducer elements and the associated discharge port, the more preferable the function. Further, in the methods including the above-mentioned method, since the OH distance substantially determines a discharge volume, it is required to set the OH distance to a precise and reproducible value.

Conventionally, a method of manufacturing ink jet recording head disclosed in the specification of U.S. Pat. No. 5,478,606 has been known. In this method, an ink passage pattern is formed on a substrate formed therein with ink discharge pressure generating elements with the use of dissoluble resin. Thereafter, coating resin containing solid-like epoxy resin is dissolved in a solvent, and is then coated over the dissoluble resin layer (solvent coating), and accordingly, a coated resin layer serving as an ink passage wall is formed on the dissoluble resin layer. After discharge ports are formed in the coated resin layer at positions just above the ink discharge pressure generating elements, the dissoluble resin layer is eluted. With this method, the distance between each of the ink discharge pressure generating elements and the associated discharge port can be set to a reproducible value with a relatively high degree of accuracy, thereby it is possible to manufacture an ink jet recording head capable of high quality recording. Further, in this method, the manufacturing process can be shortened, thereby it is possible to obtain an inexpensive and reliable ink jet recording head.

Further, there has been an increased demand for further enhancing the throughput of ink jet recording apparatuses in view of the market for digital cameras. As one of methods for satisfying this demand, there may be considered such a method that several discharge ports are densely arranged in a sub-scanning direction. In this case, it is required to shorten the horizontal distance (which will be hereinbelow referred to as "OC distance", refer to FIG. 3) between a shoulder part at an end of the ink passage pattern and a position where a discharge port is formed, in dependence upon a layout of the discharge ports.

However, even though this distance is shortened, the opening diameter of the discharge port is not changed, and accordingly, the distance h shown in FIG. 3 becomes shorter. By this reason, in the method disclosed in the specification of the U.S. Pat. No. 5,478,606, irregularity is present more or less on the outer surface of a coated resin layer around an end of the passage pattern. Thus, should the distance h be excessively short, the discharge ports would be formed in the zone where the irregularity is present.

As a result, the reproducibility of the OH distance for each of the discharge ports is lost, and as well the OH distance at the peripheral edge of the respective ones of the discharge ports becomes uneven, depending upon a position. Thus, there has been offered such a risk that the discharge volume and a discharge direction are dispersed among the discharge ports or the recording heads.

SUMMARY OF THE INVENTION

Accordingly, the present invention can provide a method capable of precisely manufacturing an ink recording head even though the density of the ink passage pattern is increased.

The present invention is devised in view such a finding that one of the causes of occurrence of irregularity on the coated resin layer is the solvent used during the formation of the coated resin layer, and accordingly, the present invention proposes such a solution, for these problems, that the necessity of using such a solution is eliminated.

According to the present invention, there is provided a method of manufacturing an ink jet recording head characterized by the steps of (1) forming an ink passage pattern on a substrate, on which ink discharge pressure generating elements are formed, from dissoluble resin;

(2) depositing an organic material on the substrate by a process of vapor deposition at a temperature at which the dissolubility of the dissoluble resin is not lost, so as to form a coated resin layer on the ink passage pattern;

(3) forming the ink discharge port in the coated resin layer; and (4) removing the ink passage pattern to form the ink passage.

According to the present invention, the ink jet recording head can be manufactured with a high degree of accuracy even though the density of the ink passage pattern is increased.

Further features of the present invention will become apparent from the following description of exemplary embodiments (with reference to the attached drawings).

DESCRIPTION OF THE EMBODIMENTS

Detailed explanation will be hereinbelow made of the present invention with reference to the accompanying drawings:

FIGS. 1A to 1D are schematic views illustrating a basic embodiment in relation to a method of manufacturing an ink jet recording head according to the present invention, which show a configuration of the ink jet recording head relating to the method according to the present invention, and process steps for manufacturing thereof as an example.

Figure 1A:
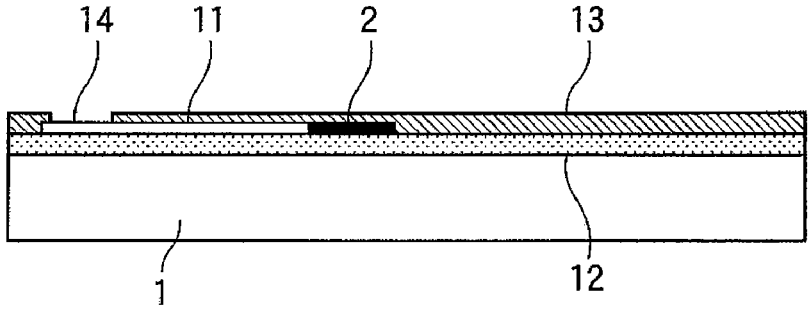
FIGS. 1A, 1B, 1C and 1D are schematic sectional views for explaining process steps for manufacturing an ink jet recording head according to the present invention.

At first, according to the present invention, as shown in FIG. 1A, a substrate made of single crystal silicon is preferably used as a substrate 1. This substrate serves as a part of a liquid passage constituting member, and further, it may be used without its shape, material and the like being limited to specific ones if it can serve as a carrier for a material layer (coated resin layer 4) which defines therein ink passages and ink discharge ports which will be described later.

Ink discharge pressure generating elements 2 are provided on the substrate by a desired number (FIG. 1A). These ink discharge elements 2 apply a discharge pressure for discharging recording droplets to recording liquid which is jetted and then settled onto a recording medium for recording. Incidentally, if, for example, electrothermal transducer elements are used as the ink discharge pressure generating elements 2, these elements heat up the recording liquid therearound so as to cause the recording liquid to change its state in order to generate a discharge pressure. Further, if, for example, piezoelectric elements are used, the piezoelectric elements cause mechanical vibration by which a discharge pressure is generated.

It is noted that the ink discharge pressure generating elements 2 are connected thereto with a drive circuit which is not shown, for operating these elements, and accordingly, a conductive layer, an insulating layer 12 and a passivation layer 13 which constitute the above-mentioned drive circuit are appropriately formed on the substrate. Further, the drive circuit is connected thereto with a pad 14 for connection to external electrodes, for inputting a control signal and a drive power to the circuit (FIG. 1A). Further, in order to enhance the durability of the ink discharge pressure generating elements 2, various function layers including a protecting layer may be provided.

In particular, it is preferably to provide, on the substrate 1, an adherence layer for enhancing the adherence between the substrate 1 and the coated resin layer 4 which will be formed later. A process step of forming the adherence layer on the substrate 1 is carried out preferably before a step of forming the coated resin layer (step (2) which will be described later). The adherence layer may be made of, for example, polyamide resin, polyimide resin, polyether amide resin or the like.

It is noted here that an ink supply port for the supply of ink may be formed in the substrate 1. For example, a hole for supplying ink is formed in the substrate 1 from the rear thereof. In order to form the ink supply port, there may be used any of various methods by using any means capable of forming a hole in the substrate. For example, the hole may be formed by using not only a mechanical means such as a drill but also photo energy such as laser. Further, chemical etching or physical etching may be used by forming a resist pattern on the rear surface of the substrate 1.

However, the formation of the ink supply port may be made after the formation of the ink discharge ports as will be described later. Further, without forming the ink supply port in the substrate 1, the ink supply port is provided in a plane the same as the ink discharge ports of the substrate 1 with the use of a method of forming an ink passage pattern including a part where the ink supply port is formed from a dissoluble resin or a method of forming an ink supply port in the coated resin layer.

Further, the ink supply port may be formed through the following process steps. That is, at first, the insulating layer, the passivation layer or the conductive layer, which are present on a surface on the ink discharge pressure generating element side at a position where the ink supply port is formed, is arranged as an etching stop layer. Then, the formation of the ink passage pattern from the dissoluble resin, which will be explained later, the formation of the coated resin layer and the formation of ink discharge ports in the coated resin layer are carried out. Thereafter, etching is carried out from the opposite surface of the substrate up to the etching stop layer.

Figure 1B:
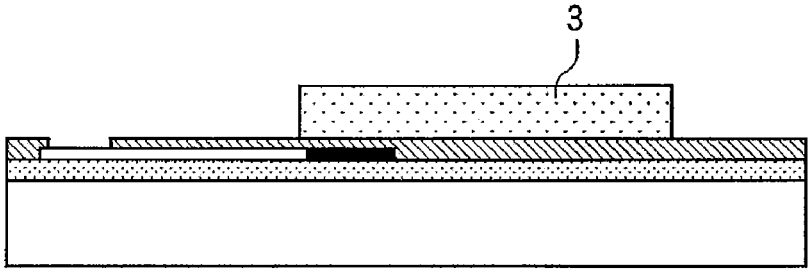

Next, as shown in FIG. 1B, an ink passage pattern 3 is formed on the substrate 1, on which the ink discharge pressure generating elements 2 are formed, with the use of dissoluble resin (Step (1)). For example, the pattern may be formed with the use of a photosensitive material which causes a desired physical property change by light irradiation. As the above-mentioned resin, there may be used, for example, a vinylketone group photodegradable polymer compound such as polymethyl-isopropylketone or polyvinylketone, or a polymer compound constituted from methacrylic acid ester such as polymethylmethacrylate. It is preferable to use the polymer compound constituted from methacrylic acid ester such as polymethylmethacrylate since this material is relatively highly heat-resistant.

The ink passage pattern 3 may be formed in such a way that dissoluble resin is applied on the substrate 1 by a spin-coat process so as to form a dissoluble resin layer, then desired pattern exposure is carried out by UV radiation or the like, and thereafter, development and a rinse process are carried out. It is noted that the ink passage pattern formed from the dissoluble resin is adapted to ensure ink passages through which ink flows between the ink supply port 6 and the ink discharge pressure generating elements 2.

According to the present invention, a high density ink passage pattern 3 may be formed. For example, a high density pattern having an OC distance of 3 to 30 μm may be formed. It is of course possible to form a pattern having a density higher than that of the former one. Further, the thickness of the ink passage pattern is normally about 5 to 40 μm.

In such a case that the substrate has been already formed therein with the ink supply port, it is preferable to carry out such a way that the dissoluble resin is dissolved in a suitable solvent, then is coated over a PET film or the like so as to obtain a dry film after being dried, and the thus obtained dry film is laminated on the substrate in order to block the ink supply port.

Next, an organic material is deposited on the substrate 1 on which the ink passage pattern 3 has been formed from the dissoluble resin, by a vapor growth process so as to form the coated resin layer (step (2)). Specifically, one or more kinds of source gas which is a raw material for forming the coated resin layer 4 is introduced into a vacuum tank, and by reacting the source gas on the substrate 1 on which the ink passage pattern 3 has been formed from the dissoluble resin, the coated resin layer 4 is formed.

At this stage, it is necessary to maintain a temperature for preventing the dissolubility of the ink passage pattern formed from the dissoluble resin from being lost, in order to form the coated resin layer 4. That is, although depending upon a kind of dissoluble resin used, it is preferable to select a material from which the coated resin layer 4 can be built up through vapor growth at a low temperature of not higher than 250° C. Further, it is more preferable to select a material which can be built up through vapor growth at a temperature at which the ink passage pattern made from the dissoluble resin is not deformed.

The resin from which the coated resin layer 4 is formed may be any one selected from, for example, a group consisting of polyparaxylylene, polymonochloroparaxylylene, polydichloroparaxylylene, and polymonofluoroparaxylylene. In the case of the formation of the coated resin layer 4, for example, dimer in a powder form is evaporated in the atmosphere of vacuum, is then radically monomerized at a high temperature of about 700° C., and is thereafter introduced into a vacuum chamber where it may be deposited on a workpiece set therein in order to form a film. At this time, the workpiece is set at a room temperature, and accordingly, substantially no affection is exerted to the dissoluble resin.

Further, the resin from which the coated resin layer 4 is formed may be any one selected from a group consisting of polyimide resin, polyamide resin, polyimideamide resin and polyazomethine resin. For example, in the case of the coated resin layer 4 being made from the polyimide resin, the following process steps are taken: pyromellitic acid anhydride and oxydianiline as raw materials are vaporized, then are introduced into a vacuum tank which is maintained at a temperature of 200° C. so as to deposit polyamic acid, which is produced under deposition and polymerization, on a workpiece set therein, and thereafter, the thus deposited polyamide acid is heated up to a temperature of 250° C. so as to obtain a polyamide resin layer. In this case, since it is heated up to 250° C., polymethylmethacrylate or the like which is relatively heat-resistant is selected as the above-mentioned dissoluble resin.

Further, as the resin from which the coated resin layer 4 is formed, there may be selected polyurea resin. In order to form the coated resin layer from the polyurea resin, aromatic or aliphatic diamine and aromatic or aliphatic diisocyanate which are raw materials of the polyurea resin are evaporated, and then introduced into a vacuum chamber so as to be deposited on a workpiece which is controlled to a temperature not higher than 100° C. so that a film is formed. At this time, the workpiece is maintained at a temperature not higher than 100° C., and accordingly, substantially no affection is applied to the dissoluble resin.

One or more organic materials, from which the coated resin layer is formed, may be used. When not less than two kinds of organic materials are used for the formation of the coated resin layer, any one of the preferable organic materials as stated above may be preferably used as a main component. It is noted that a component having a largest content among the organic materials, from which the coated resin is formed, becomes the main component.

Thus, during the vapor growth of the organic substance, the film may be sufficiently formed even though the workpiece to be formed thereon with a film is at a low temperature of not higher than 250° C.

The thickness of the coated resin layer is normally set in a range from 1 to 100 μm.

Figure 1C:
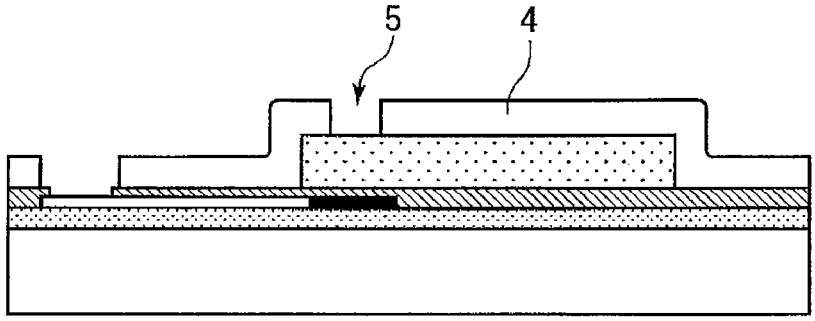

Next, as shown in FIG. 1C, the coated resin layer is formed therein with ink discharge ports in parts which are located above the ink discharge pressure generating elements (step (3)).

At this step (3), a resist is coated over the coated resin layer and is then patterned by photolithography technology so as to form the ink discharge ports in the parts above the ink discharge pressure generating elements. Thereafter, the coated resin layer is processed by etching and then the resist is removed so as to form the ink discharge ports. The etching may be carried out by RIE or the like with the use of etching gas which is mixed therein with, for example, oxygen gas or chlorine gas.

At the step (3), the ink discharge ports may be formed mechanically or physically. Specifically, there may be enumerated processes using a microdrill, laser, FIB and the like.

Further, in the case of selection of polyurea resin as the organic material from which the coated resin layer is formed, the polyurea resin just after the vapor deposition falls in an oligomer condition, and accordingly, its negative photosensitivity owned by the polyurea resin may be used. Should the polyurea resin be abruptly heated up to a temperature of not lower than 200° C. as it is, just after the vapor deposition, the depolymerization reaction would be progressed so that the monomer is evaporated in a vacuum condition, resulting in elimination of the film. However, the report written by Mr. Takahashi of Alpack Co., Ltd., shows that the film is not eliminated through the irradiation of UV radiation even though it is heated up to a temperature not lower than 200° C. (Photoresist Characteristics of Polyurea Films Prepared by Vapor Deposition Polymerization, Jpn. J. Phys, Vol. 33 (1994) pp. L1721 to L1724).

This report also shows such a fact that unreacted isocyanate group and urea combining site are reacted upon irradiation of UV radiation, and are combined so that it is changed into a different configuration while the molecular weight thereof is increased, and accordingly, the negative photosensitivity may be exhibited.

When the geometry of the ink jet head, thickness of the coated resin layer and size of discharge ports, is suited, the ink discharge ports may be formed by, for example, the following method with the use of this property. At first, in a condition in which a zone at least including a part where the ink discharge ports are to be formed is masked by a photomask, exposure is made by irradiation of UV radiation. At this exposure stage, an exposure apparatus such as PLA501 manufactured by Canon Co., incorporating a Xe—Hg lamp having an output power of 50 W may be used. Thereafter, if the selected dissoluble resin is not heat-resistant, this is eluted and removed beforehand, and is heated up to a temperature of not lower than 200° C., so as to form the ink discharge ports. At this stage, a pressure of not higher than $5\times10^{-4}$ Pa and a temperature of 250° C. are preferably maintained for not shorter than about 30 min.

Alternatively, they are dipped in an alkaline solution such as an about 10 wt. % NaOH solution for about 20 min so as to hydrolyze the urea combining site for low molecularization. Further, development is made by eluting and removing a part of the low molecular portion which has not been irradiated by UV radiation, with the use of an organic solvent such as methyl-2-pyrolidone, and accordingly, the ink discharge ports may be formed. In this case, without using the resist, a large number of the ink discharge ports may be formed in a batch, and accordingly, it is advantageous in view of the costs.

Next, if no ink supply port has yet been formed, the substrate is processed from the rear surface thereof so as to form the ink supply port. Any of a plurality of methods may be used as the processing method as stated above, and there may be preferably used such a method that the etching is carried out up to the etching stop layer formed on the front surface of the substrate after the formation of the dissoluble resin layer on the front surface of the substrate, and thereafter, the etching stop layer and the dissoluble resin layer are selectively removed.

Figure 1D:
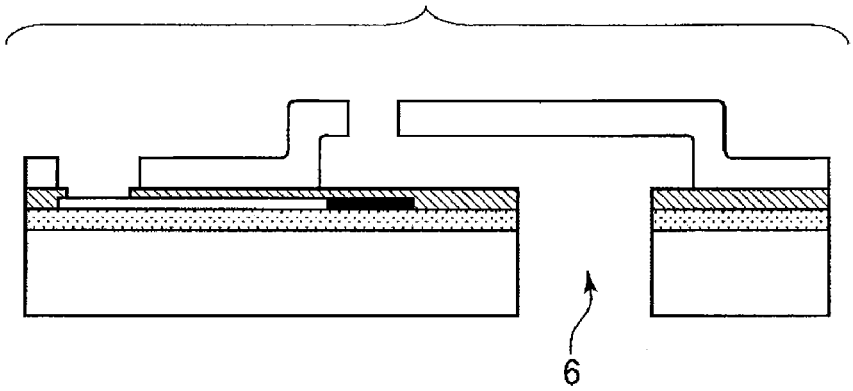

The substrate is dipped in a solvent or the like, the dissoluble resin is removed from the ink discharge ports 5 and the ink supply port 6 (step (4), FIG. 1D). If a photosensitive material such as a vinylketone group photodegradable polymer compound or a polymer compound constituted by methacrylate acid ester is used as the dissoluble resin, it may be exposed by UV radiation beyond the coated resin layer 4, and then, may be eluted by the lactated methyl or the like. Ultrasonic wave or the like may be applied as the case may be.

Further, the substrate is cut out in a chip-like condition by dicing, and the assembly is made in a cartridge condition, thereby it is possible to obtain an ink jet recording head according to the present invention.

Figure 2:
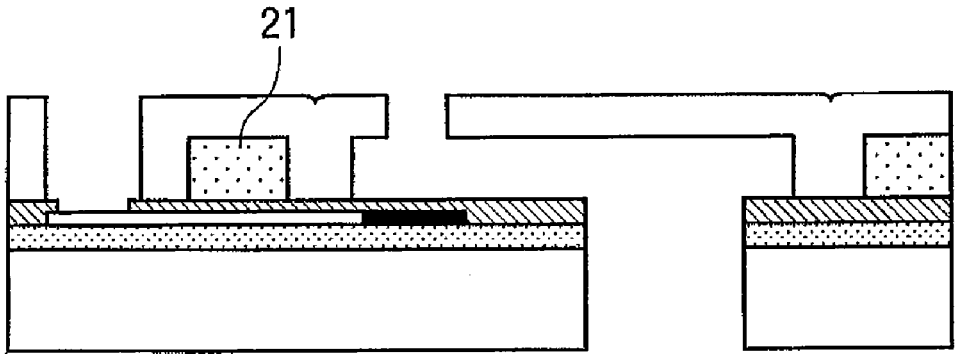
FIG. 2 is a schematic sectional view illustrating an ink jet recording head in a variant form of the present invention.
Figure 3:
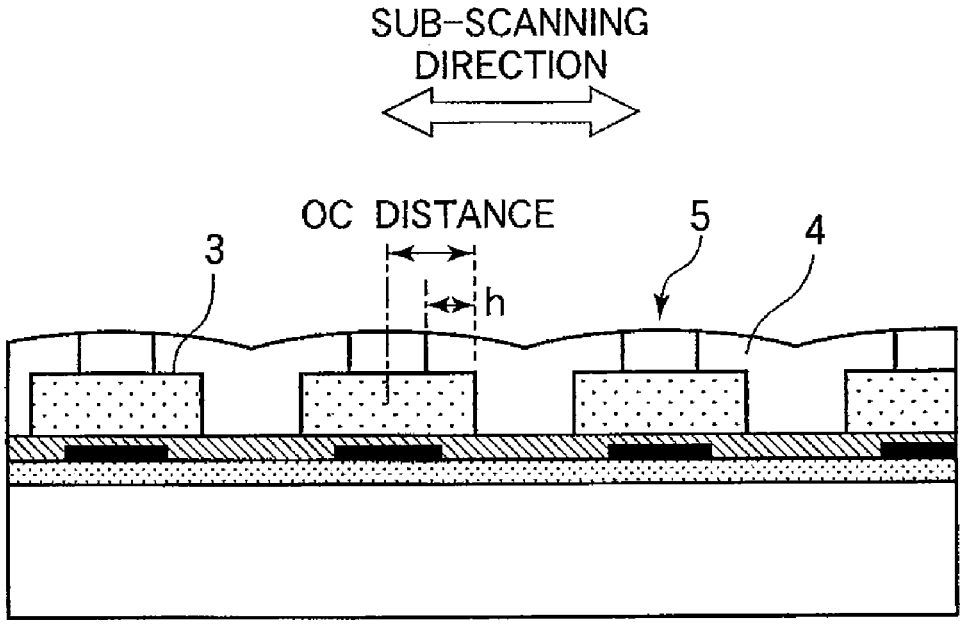
FIG. 3 is a schematic sectional view illustrating an ink jet recording head having a short OC distance.

Further, in several ink jet recording apparatuses, recovery operation for wiping the outer surface of the coated resin layer by a blade is carried out for maintaining the image quality reliability. In order to enhance the durability against this operation, it is desirable to allow the coated resin layer to be flat over a wide range, not only around the ink passage forming place. Thus, the dissoluble resin layer is preferably provided as a dummy dumper in a place other than the ink passage forming place. Accordingly, the outer surface of the coated resin layer may be flattened (FIG. 2). At this stage, the distance between the dissoluble resin pattern for forming the ink passages and the dummy damper, is preferably set to a value which is not greater than 2 times as large as the film thickness of the coated resin layer.

EMBODIMENTS

Explanation will be made of embodiments of the present invention.

Embodiment 1

At first, electrothermal transducer elements (heat generating resistors made of TaN) as discharge pressure elements, a drive circuit therefor, and an etching stop layer formed from a silicon oxide film were formed on a single crystal silicon substrate.

Next, polyamide resin was coated so as to form an adherence layer, and after baking, a novolac group photoresist was coated. After patterning of the novolac group photoresist with the use of photolithographic technology, the polyamide resin at least on the electrothermal transducer elements, on pads for external electrodes, and at the supply port forming position was removed by chemical dry etching with the use of $CF_4$ and $O_2$. Thereafter, the novolac group photoresist was removed by a monoamine group stripper.

Then, polymethylisopropenylketone as dissoluble resin was coated on the substrate by a spin coat process so as to form a dissoluble resin layer. After prebaking for 20 min. at a temperature of 120° C., pattern exposure of about 20 J/cm$^2$ was carried out by UV radiation having a wavelength of about 248 nm. Then, development was made with the use of methylisobutylketone/xylene=2/1, and rinsing was made with xylene. It is noted that the ink passage pattern formed with the dissoluble resin was adapted to ensure ink passages through which ink flows between the ink supply port and the electrothermal transducer elements.

Next, polyparaxylylene was deposited by a CVD process. Specifically, dimmer in a powder form as a raw material was heated up to a temperature of about 140° C. so as to be sublimated in such a condition that a chamber was evacuated up to an order of 0.1 Pa, then was radically monomerized at a temperature of about 65° C. in a cracking furnace, and thereafter was fed onto a workpiece. The novolac group photoresist was coated thereover. Then, with the use of a photomask having a certain pattern, pattern exposure for forming the ink discharge ports was carried out. Thereafter, it is dipped in an about 3 wt. % TMAH aqueous solution so as to be developed. Then, gas was introduced onto a parallel-plate type RID for etching so as to form the ink discharge ports, and thereafter, the novolac group photoresist was removed by a monoamine group stripper.

Next, a novolac group resist was coated on the rear surface of the substrate so as to carry out patterning in order to remove the ink supply port forming place by a photolithographic process. Thereafter, etching was made from the rear surface of the substrate up to the silicon oxide layer at the front surface thereof with the use of ICP-RIE etcher so as to form the ink supply port.

The resin layer of the front surface of the substrate which was protected thereover with cyclized rubber was dipped in a BHF solution so as to remove the oxidized silicon film from the bottom part of the ink supply port. Then, the passivation layer made of silicon nitride was removed by etching. Thereafter, the cyclized rubber was removed by xylene.

UV radiation having a wavelength of about 248 nm was irradiated from the front surface of the substrate by about 20 J/cm$^2$ so as to photosensitize polymethylisopropenylketone through the coated resin layer made of polyparaxylylene, and thereafter, polymethylisopropenylketone was dissolved and removed by lactated methyl.

A chip part incorporated in the head was cut off from the silicon substrate by a dicer, and was then assembled in a cartridge in order to obtain an ink jet recording head.

Embodiment 2

In this embodiment, polymethylmethaclyrate was selected as the dissoluble resin, and was then patterned so as to form an ink passage pattern by process steps similar to those in the embodiment 1.

Then, substrate was introduced in a vacuum chamber which has been evacuated up to about $10^{-3}$ Pa, and 4,4'-diphenylmethandiisocyanate (MDI) and 4,4'-methylenedianiline (MDA) were introduced by being heated up to temperatures of 71° C., 100° C., respectively, and sublimated. Polyurea resin was formed into a film by a deposition polymerization process. The novolac group photoresist was coated thereover. Then, with the use of a photomask having a certain pattern, pattern exposure for forming the ink discharge ports was carried out. Thereafter, it is dipped in an about 3 wt. % TMAH aqueous solution so as to be developed. Then, gas was introduced onto a parallel-plate type RIE for etching so as to form the ink discharge ports, and thereafter, the novolac group photoresist was removed by a monoamine group stripper.

Next, novolac group resist was coated over the rear surface of the substrate, and was then patterned by a photolithographic process so that the ink supply port forming place was to be removed. Etching was made from the rear surface of the substrate up to the oxidized silicon film at the front surface of by ICP-RIE etcher in order to form the ink supply port.

The resin layer of the front surface of the substrate which was protected thereover with cyclized rubber was dipped in a BHF solution so as to remove the oxidized silicon film from the bottom part of the supply port. Then, the passivation layer made of silicon nitride was removed by dry etching.

UV radiation having a wavelength of about 248 nm was irradiated from the front surface of the substrate by about 20 J/cm$^2$ so as to photosensitize polymethylmethacrylate through the coated resin layer made of polyurea resin, and thereafter, polymethylmethacrylate was dissolved and removed by lactated methyl.

A chip part to be incorporated in the head was cut off from the silicon substrate by a dicer, and was then assembled in a cartridge in order to obtain an ink jet recording head.

The ink jet recording head according to the present invention had the discharged ports which were densely arranged in a sub-scanning direction, and the discharge direction of ink droplets is stable while high throughput was materialized. Thereby, the ink jet recording head was the one capable of obtaining a high quality image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A method of manufacturing an ink jet recording head comprising an energy generating element for generating energy used to discharge ink from an ink discharge port, and an ink passage to communicate with the ink discharge port, comprising the steps of:

forming a pattern of the ink passage from dissoluble resin on a substrate having the energy generating element;

depositing polyurea resin on the substrate by a process of vapor deposition at a temperature at which the dissolubility of the dissoluble resin is not lost, so as to form a coated resin layer made of polyurea resin on the pattern;

forming the ink discharge port in the coated resin layer;

irradiating the pattern with light through the coated resin layer; and removing the pattern to form the ink passage.

2. A method of manufacturing an ink jet recording head as set forth in claim 1, wherein the step of forming the coated resin layer introduces one or more kinds of source gas as a raw material for forming the coated resin layer, into a vacuum tank, and allows the source gas to be reacted on the substrate on which the pattern is formed from the dissoluble resin so as to form the coated resin layer.

3. A method of manufacturing an ink jet recording head comprising an energy generating element for generating energy used to discharge ink from an ink discharge port, and an ink passage to communicate with the ink discharge port, comprising the steps of:

forming a pattern of the ink passage from dissoluble resin on a substrate having the energy generating element;

depositing polyurea resin on the substrate by a process of vapor deposition at a temperature at which the dissolubility of the dissoluble resin is not lost, so as to form a coated resin layer made of polyurea resin on the pattern;

forming the ink discharge port in the coated resin layer by performing a dry etching on the coated resin;

irradiating the pattern with light through the coated resin layer, a curing reaction proceeding in the coated resin layer by the irradiation of light; and removing the pattern to form the ink passage.

* * * * *